US009488186B2

(12) United States Patent
Hornbach

(10) Patent No.: US 9,488,186 B2
(45) Date of Patent: Nov. 8, 2016

(54) EXHAUST-GAS TURBOCHARGER

(75) Inventor: Johannes Hornbach, Frankenthal (DE)

(73) Assignee: BorgWarner Inc., Auburn Hills, MI (US)

( * ) Notice: Subject to any disclaimer, the term of this patent is extended or adjusted under 35 U.S.C. 154(b) by 515 days.

(21) Appl. No.: 14/007,165

(22) PCT Filed: Apr. 2, 2012

(86) PCT No.: PCT/US2012/031792

§ 371 (c)(1),
(2), (4) Date: Oct. 28, 2013

(87) PCT Pub. No.: WO2012/141924

PCT Pub. Date: Oct. 18, 2012

(65) Prior Publication Data

US 2014/0056698 A1 Feb. 27, 2014

(30) Foreign Application Priority Data

Apr. 13, 2011 (DE) ..... 10 2011 016 916

(51) Int. Cl.
*F01D 25/18* (2006.01)
*F04D 29/06* (2006.01)
*F02B 39/14* (2006.01)

(52) U.S. Cl.
CPC ..... *F04D 29/06* (2013.01); *F01D 25/18* (2013.01); *F02B 39/14* (2013.01); *F05D 2220/40* (2013.01); *F05D 2260/85* (2013.01)

(58) Field of Classification Search
CPC .... F04D 29/063; F04D 29/43; F04D 29/056; F01D 25/18; F01D 25/20; F05D 2220/40; F05D 2260/98; F02B 39/14
See application file for complete search history.

(56) References Cited

U.S. PATENT DOCUMENTS 3,304,802 A * 2/1967 Siegfried ..... F01D 25/164 464/180
4,240,678 A * 12/1980 Sarle ..... F01D 25/166 384/369
4,850,820 A * 7/1989 Gutknecht ..... F01D 25/125 417/407
4,884,406 A * 12/1989 Kawamura ..... F01D 25/125 60/605.3
2007/0081906 A1 4/2007 Wood
2010/0061855 A1 3/2010 Shashank et al.
2010/0064684 A1* 3/2010 Nishiyama ..... F01D 17/143 60/602

FOREIGN PATENT DOCUMENTS

JP 07-139363 A 5/1995
JP 2001-003759 A 1/2001

* cited by examiner

*Primary Examiner* — Ninh H Nguyen
(74) *Attorney, Agent, or Firm* — A. Michael Tucker; Stephan A. Pendorf; Patent Central LLC

(57) ABSTRACT

An exhaust-gas turbocharger (1) having a compressor (2); a turbine (3); and a bearing housing (4) which has a lubricant device (5) for shaft bearings (6, 7), which lubricant device can be connected via a lubricant feed line (8) to an engine lubricant circuit. A lubricant storage vessel (9) is connected between the lubricant feed line (8) and the lubricant device (5) of the bearing housing (4).

9 Claims, 2 Drawing Sheets

EXHAUST-GAS TURBOCHARGER

BACKGROUND OF THE INVENTION

1. Field of the Invention

The invention relates to a turbocharger turbine.

2. Description of the Related Art

During a cold start of an engine equipped with an exhaust-gas turbocharger, there can be relatively long delays in the supply of oil to the bearing arrangement of the bearing housing of the turbocharger. As a result of long and unfavorably laid lines, there is the risk of the turbocharger initially running without lubrication. This can be exacerbated at sub-zero temperatures in that the oil is viscous or solid, and the supply of oil is further delayed or the rotor seizes. Wear phenomena owing to deficient lubrication may also arise during the shut-down of the engine, as a result of afterrunning of the rotor.

It is therefore an object of the present invention to provide an exhaust-gas turbocharger which makes it possible to eliminate the problems, explained in the introduction, during cold start and during afterrunning.

BRIEF SUMMARY OF THE INVENTION

By virtue of the fact that an additional oil storage vessel is connected between the lubricant feed line and the lubricant device of the bearing housing, it is possible for an oil store to be provided in the direct vicinity of the bearing arrangement, which oil store can supply the required oil quantity to the bearing arrangements without a time delay during a cold start and during afterrunning. When a pressure prevails in the lubricant feed line, the lubricant (oil) is forced out of the oil storage vessel into the bearing housing.

The subclaims relate to advantageous refinements of the invention.

If the oil storage vessel is formed as a separate component which can be mounted, preferably screwed onto the bearing housing, retrofitting of exhaust-gas turbochargers is also possible without technical problems, because it is necessary merely for the lubricant feed line to be relocated upward by the height of the oil storage vessel.

The oil storage vessel preferably has a siphon via which the lubricant can be forced into the bearing housing when an adequate lubricant pressure prevails.

It is furthermore possible for a heating element (for example in the form of a heating foil or a heating rod) to be integrated in the lubricant vessel. In this way, the lubricant can be pre-heated by the engine controller and also accelerate the breakaway of the shaft assembly, or enable said breakaway before the starting of the engine.

BRIEF DESCRIPTION OF THE SEVERAL VIEWS OF THE DRAWINGS

Further details, advantages and features of the present invention will emerge from the following description of an exemplary embodiment on the basis of the drawing, in which.

DETAILED DESCRIPTION OF THE INVENTION

Figure 1:
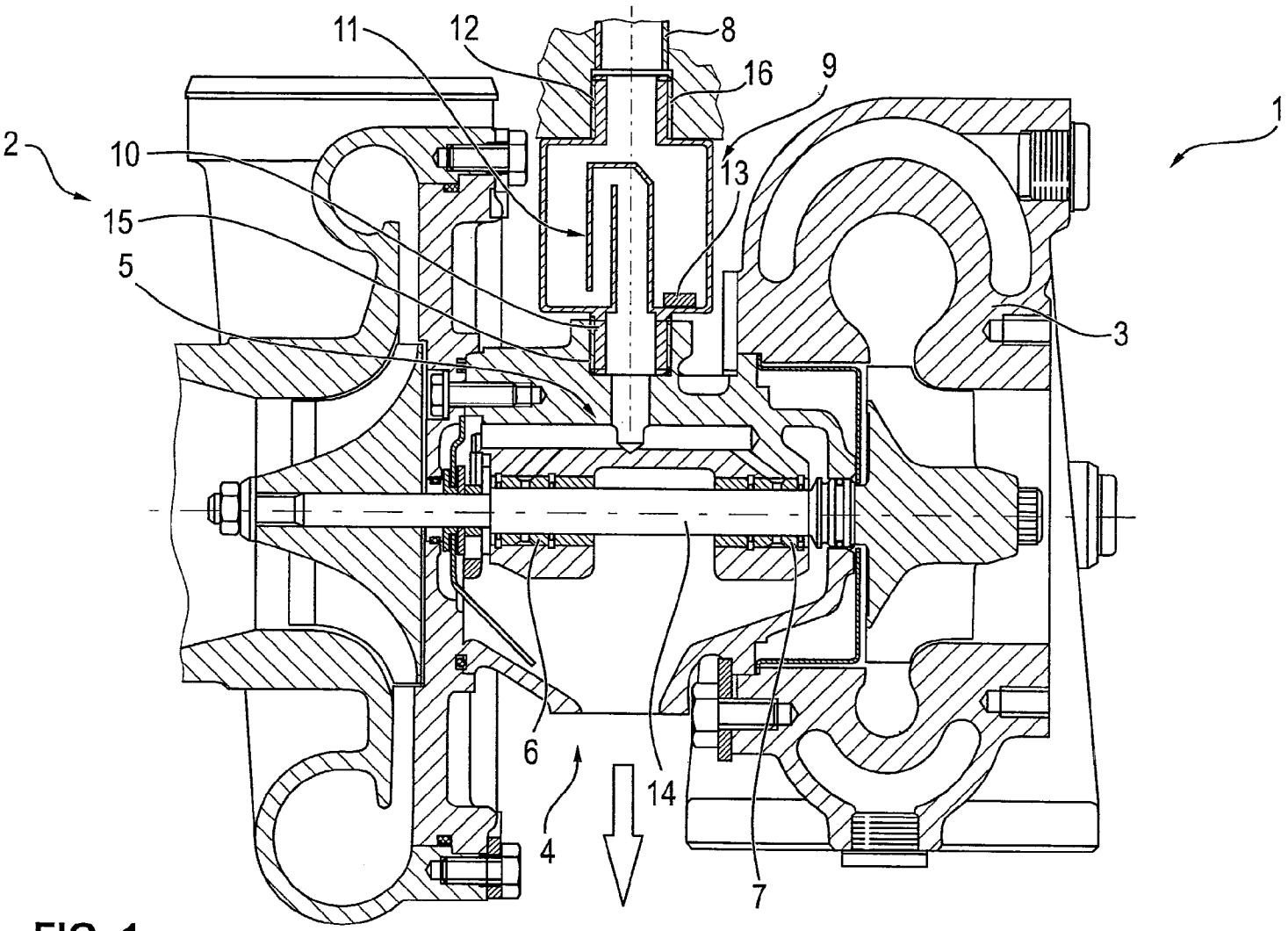
FIG. 1 shows a sectional illustration through an exhaust-gas turbocharger according to the invention.

FIG. 1 illustrates an exhaust-gas turbocharger 1 according to the invention which has a compressor 2 and a turbine 3.

Arranged between the compressor 2 and turbine 3 is a bearing housing 4. The bearing housing 4 has a lubricant device 5 for shaft bearings 6 and 7 of a rotor shaft 14. In the particularly preferred embodiment illustrated in FIG. 1, a lubricant storage vessel (oil storage vessel) 9 is connected between a lubricant feed line 8, which leads from the engine oil circuit, and the lubricant device 5 of the bearing housing 4. For this purpose, the lubricant vessel 9 has an oil feed connector 10 which, in the example, is provided with an external thread 15 which is screwed into a corresponding internal thread of the bearing housing 4. The lubricant storage vessel 9 is connected to the lubricant feed line 8 via a line port 12 which, in the example, has an internal thread 16 which interacts with a corresponding external thread of the lubricant feed line 8, such that after the above-described assembly has taken place, the lubricant device 5 of the bearing housing 4 is flow-connected to the lubricant feed line 8 via the lubricant storage vessel 9.

Figure 2:
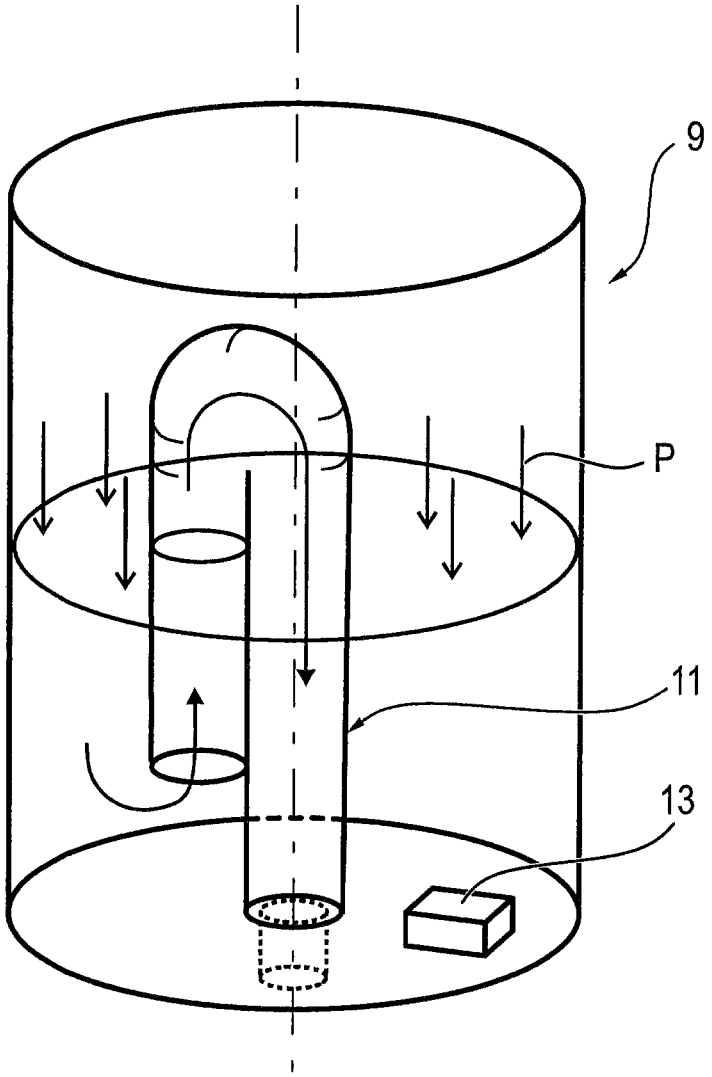
FIG. 2 shows a schematically highly simplified perspective diagrammatic illustration of a lubricant vessel of the exhaust-gas turbocharger according to the invention.

As can be seen from FIGS. 1 and 2 viewed together, there is arranged in the interior of the lubricant storage vessel 9 a siphon 11 via which, when pressure is exerted (symbolized in FIG. 2 by the arrows P), lubricant, in particular oil, is forced into the lubricant device 5 of the bearing housing 4. Since the lubricant storage vessel 9 is arranged directly on the bearing housing 4, the distance that the supplied lubricant (oil) must cover to reach the bearings 6, 7 is shortened considerably, such that the problems during a cold start or during the afterrunning of the charger, as mentioned in the introduction, can be eliminated through the provision of the lubricant storage vessel 9.

To possibly pre-heat the oil, the lubricant vessel 9 can be provided with a heating element which is symbolized in FIG. 1 by the block 13.

In addition to the above written disclosure of the invention, reference is hereby explicitly made, to supplement said disclosure, to the illustration of the invention in FIGS. 1 and 2.

LIST OF REFERENCE SYMBOLS

1 Exhaust-gas turbocharger
2 Compressor
3 Turbine
4 Bearing housing
5 Lubricant device
6, 7 Shaft bearings
8 Lubricant feed line
9 Lubricant storage vessel
10 Lubricant feed connector
11 Siphon
12 Line port
13 Heating element
14 Rotor shaft
15 External thread
16 Internal thread
P Pressure arrows

The invention claimed is:

1. An exhaust-gas turbocharger (1), having
a compressor (2);
a turbine (3); and
a bearing housing (4) which has a lubricant device (5) for shaft bearings (6, 7), which lubricant device is connected via a lubricant feed line (8) to an engine lubricant circuit, wherein
a lubricant storage vessel (9) is connected between the lubricant feed line (8) and the lubricant device (5) of the bearing housing (4) such that when a pressure prevails in the lubricant feed line, the lubricant is forced out of the lubricant storage vessel into the bearing housing.

2. The exhaust-gas turbocharger as claimed in claim 1, wherein the lubricant storage vessel (9) is mounted on the bearing housing (4).

3. The exhaust-gas turbocharger as claimed in claim 1, wherein the lubricant storage vessel (9) has a feed connector (10) which is screwed into the bearing housing (4).

4. The exhaust-gas turbocharger as claimed in claim 1, wherein the lubricant storage vessel has a line port (12) which is connected to the lubricant feed line (8).

5. An exhaust-gas turbocharger (1), having a compressor (2);

a turbine (3); and a bearing housing (4) which has a lubricant device (5) for shaft bearings (6, 7), which lubricant device is connected via a lubricant feed line (8) to an engine lubricant circuit, wherein a lubricant storage vessel (9) is connected between the lubricant feed line (8) and the lubricant device (5) of the bearing housing (4), and wherein the lubricant storage vessel (9) has a siphon (11).

6. An exhaust-gas turbocharger (1), having a compressor (2);

a turbine (3); and a bearing housing (4) which has a lubricant device (5) for shaft bearings (6, 7), which lubricant device is connected via a lubricant feed line (8) to an engine lubricant circuit, wherein a lubricant storage vessel (9) is connected between the lubricant feed line (8) and the lubricant device (5) of the bearing housing (4), and wherein the lubricant storage vessel (9) is provided with at least one heating element (13).

7. A lubricant storage vessel (9) for an exhaust-gas turbocharger (1), wherein the lubricant storage vessel (9) has a feed connector (10) which is screwed into a turbocharger bearing housing (4), wherein the lubricant storage vessel (9) has a siphon (11).

8. The lubricant storage vessel (9) according to claim 7, wherein the lubricant storage vessel has a line port (12) which can be connected to a lubricant feed line (8) of the turbocharger.

9. A lubricant storage vessel (9) according to claim 7, wherein the lubricant storage vessel (9) is provided with at least one heating element (13).

* * * * *